US008096232B1

(12) United States Patent
Davis

(10) Patent No.: US 8,096,232 B1
(45) Date of Patent: Jan. 17, 2012

(54) FOOD CUTTING AND MANIPULATING APPARATUS

(76) Inventor: Wayne Davis, Hamilton, MS (US)

( * ) Notice: Subject to any disclaimer, the term of this patent is extended or adjusted under 35 U.S.C. 154(b) by 457 days.

(21) Appl. No.: 12/358,338

(22) Filed: Jan. 23, 2009

(51) Int. Cl.
*B26D 3/11* (2006.01)
*B26D 3/00* (2006.01)

(52) U.S. Cl. ..... 99/538; 452/142

(58) Field of Classification Search ..... 99/537, 99/567, 538, 589, 592, 594; 452/142; 425/363
See application file for complete search history.

(56) References Cited

U.S. PATENT DOCUMENTS 1,763,445 A * 6/1930 Romero ..... 425/363
2,346,686 A 4/1944 Horton
2,450,688 A 10/1948 Richard
2,718,028 A 9/1955 Read et al.
3,222,712 A 12/1965 Deckert
3,716,893 A * 2/1973 Vogelsang ..... 452/142
4,619,192 A * 10/1986 Cycyk et al. ..... 99/538
D291,411 S 8/1987 Crawford

* cited by examiner

*Primary Examiner* — Kien Nguyen

(57) ABSTRACT

A food cutting and manipulating apparatus includes having an aperture extending therethrough. A gear housing is mounted on the table and includes first and second driving axles. A plurality of pairs of food manipulating members is provided. Each of the manipulating members includes a shaft, releasably engageable with the first and second driving axles, attached to an elongated base. The plurality of pairs of food manipulating members includes a plurality of pairs of cutting members. Each of the cutting members includes at least one cutting plate that is attached to the base. The at least one cutting plate extends over the aperture when the shaft is attached to the one of the first and second driving axles. Food is positionable between the food manipulating members and the motor turned on so that the food manipulating members engage the food as the food moves downwardly through the aperture.

9 Claims, 5 Drawing Sheets

FOOD CUTTING AND MANIPULATING APPARATUS

BACKGROUND OF THE INVENTION

Field of the Invention

The present invention relates to food processing devices and more particularly pertains to a new food processing device for cutting a plurality of different types of food materials.

SUMMARY OF THE INVENTION

The present invention meets the needs presented above by generally comprising a table that has an upper side and a lower side. A plurality of legs is attached to and extends downwardly from the lower side. The upper side has an aperture extending therein and through the lower side. A gear housing is mounted on the table and is positioned adjacent to the aperture. A gear assembly is mounted within the gear housing and includes a first drive gear and a second drive gear. The first and second drive gears rotate in opposite directions with respect to each other when the gear assembly is actuated. A motor is mechanically coupled to the gear assembly and is adapted for actuating the gear assembly. A first driving axle is attached to the first drive gear. The first driving axle extends through the housing and toward the aperture. The first driving axle has a free end defining a first coupler. A second driving axle is attached to the second drive gear and the second driving axle extends through the housing and toward the aperture. The second driving axle has a free end defining a second coupler. The first and second driving axles are orientated parallel with respect to each other. A plurality of pairs of food manipulating members is provided. Each of the manipulating members includes a shaft, releasably engageable with the first and second driving axles, and a base having a first end, a second end and a perimeter wall extending between the first and second ends. The first end is attached to the shaft and the shaft is centered on the first end and is aligned with a longitudinal axis of the base extending through the first and second ends. The plurality of pairs of food manipulating members includes a plurality of pairs of cutting members. Each of the cutting members includes at least one cutting plate that is attached to the base. The at least one cutting plate extends over the aperture when the shaft is attached to the one of the first and second driving axles. The at least one cutting plate of a one cutting member is spaced less than 0.05 inches from the base of another one of the cutting members when associated ones of a pair of cutting members are coupled to the first and second driving axles. Food is positionable between the food manipulating members and the motor turned on so that the food manipulating members engage the food as the food moves downwardly through the aperture.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
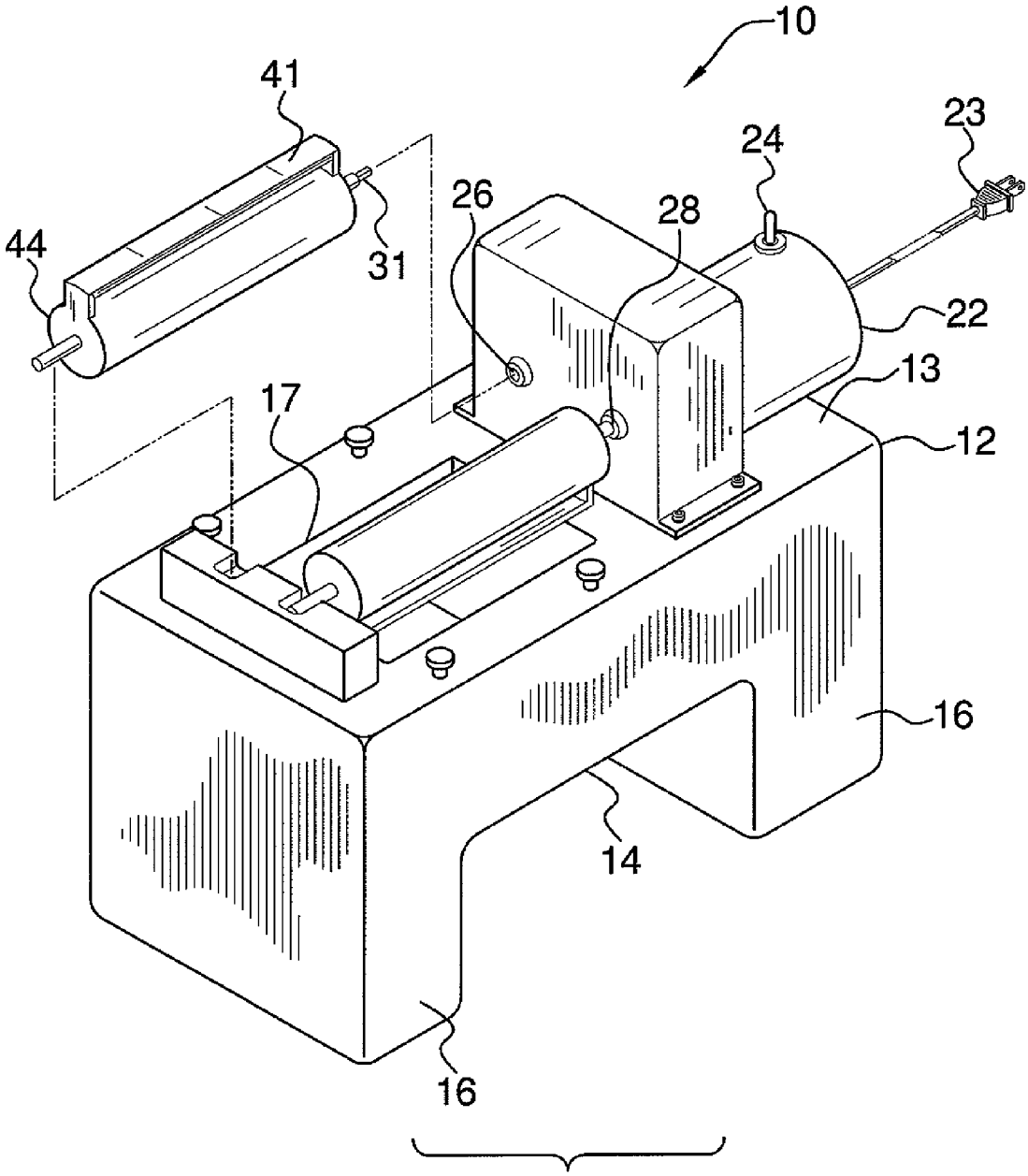
FIG. 1 is a top perspective view of a food cutting and manipulating apparatus according to the present invention.
Figure 2:
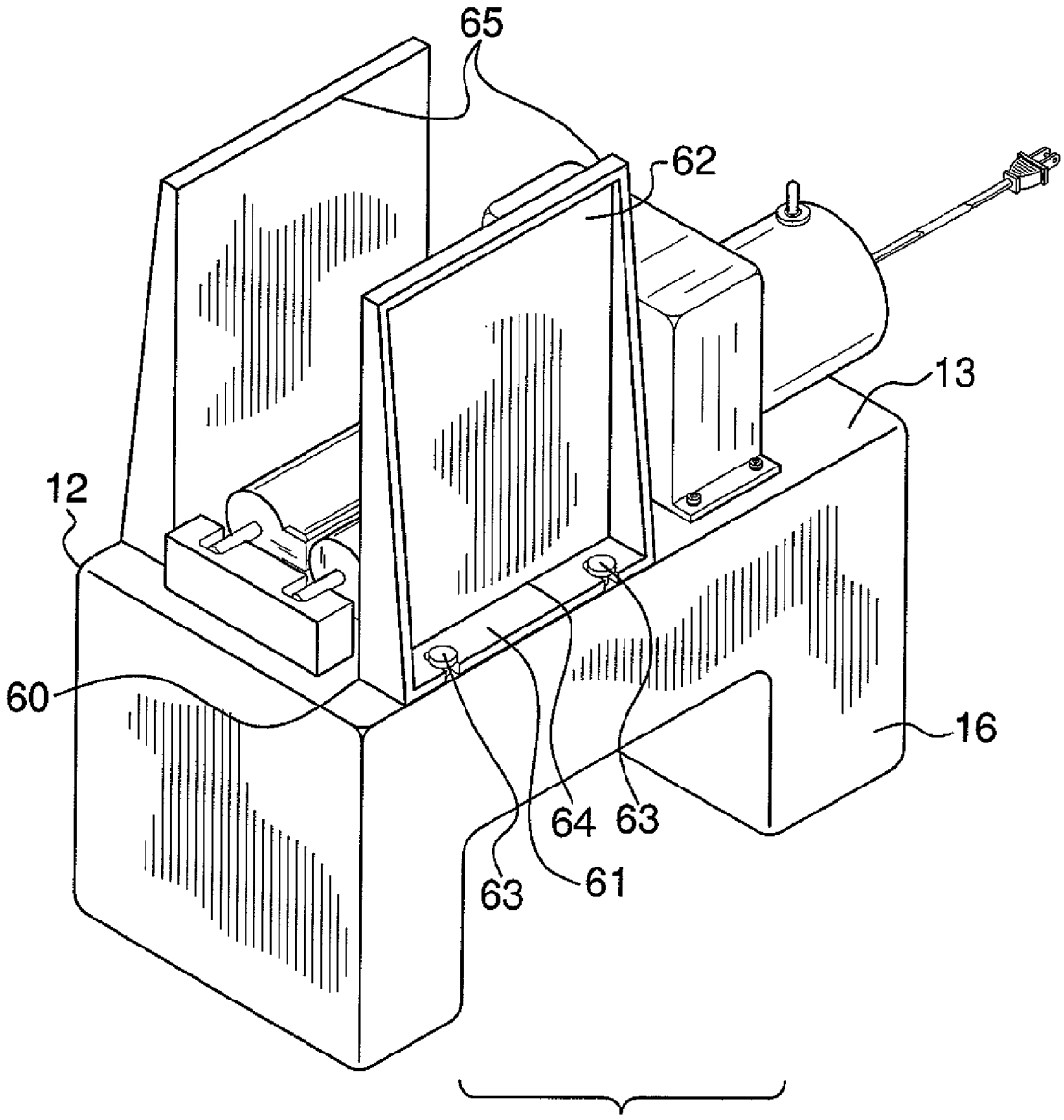
FIG. 2 is a top perspective view of the present invention.
Figure 3:
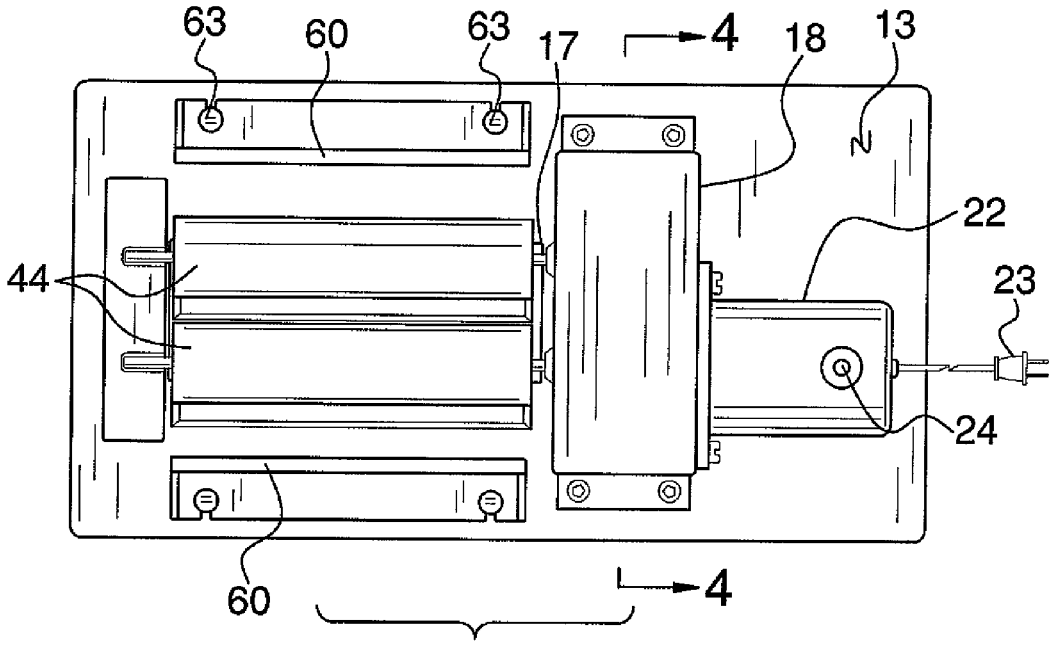
FIG. 3 is a top view of the present invention.
Figure 4:
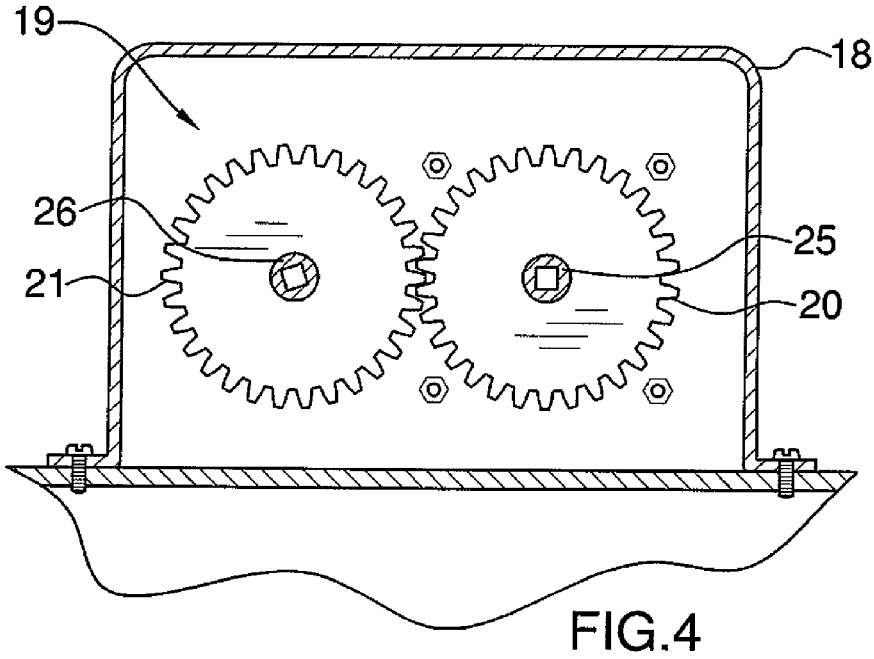
FIG. 4 is a cross-sectional view taken along line 4-4 of FIG. 3 of the present invention.

With reference now to the drawings, and in particular to FIGS. 1 through 7 thereof, a new food processing device embodying the principles and concepts of the present invention and generally designated by the reference numeral 10 will be described.

As best illustrated in FIGS. 1 through 7, the food cutting and manipulating apparatus 10 generally comprises a table 12 that has an upper side 13 and a lower side 14. A plurality of legs 16 is attached to and extends downwardly from the lower side 14. The upper side 13 has an aperture 17 extending therein and through the lower side 14. A gear housing 18 is mounted on the table 12 and is positioned adjacent to the aperture 17. A gear assembly 19 is mounted within the gear housing 18. The gear assembly 19 includes a first drive gear 20 and a second drive gear 21. The first 20 and second 21 drive gears rotate in opposite directions with respect to each other when the gear assembly 19 is actuated. A motor 22 is mechanically coupled to the gear assembly 19 and is adapted for actuating the gear assembly 19. In particular, the motor 22 is mechanically coupled to the first 20 and second 21 drive gears. The motor 22 is an electric motor pluggable into a power outlet with a power cord 23. A power button 24 operationally coupled to the motor 22 is used to turn the motor 22 on or off.

A first driving axle 25 is attached to the first drive gear 20. The first driving axle 25 extends through the housing 18 and toward the aperture 17. The first driving axle 25 has a free end that defines a first coupler. A second driving axle 26 is attached to the second drive gear 21. The second driving axle 26 extends through the housing 18 and toward the aperture 17. The second driving axle 26 has a free end that defines a second coupler. The first 25 and second 26 driving axles are orientated parallel with respect to each other.

A plurality of pairs of food manipulating members 30 is provided. Each of the manipulating members 30 includes a shaft 31. The first 25 and second 26 driving axles each receive and releasably engage the shaft 31 of an associated one of the manipulating members 30. In this manner, the manipulating members 30 may be removed and replaced as needed for manipulating members 30 suited for particular tasks, as will be further described below. A base 32 has a first end 33, a second end 34 and a perimeter wall 36 extending between the first 33 and second 34 ends. The first end 33 is attached to the shaft 31 and the shaft 31 is centered on the first end 33 and aligned with a longitudinal axis of the base 32 extending through the first 33 and second 34 ends.

The plurality of pairs of food manipulating members 30 includes a plurality of pairs of cutting members 40. Each of the cutting members 40 includes at least one cutting plate 41 that is attached to the base 32. The at least one cutting plate 41 extends over the aperture 17 when the shaft 31 is attached to the one of the first 25 and second 26 driving axles. The at least one cutting plate 41 of a one cutting member 40 is spaced less than 0.05 inches from the base 32 of another one of the cutting members 40 when associated ones of a pair of cutting members 40 are coupled to the first 25 and second 26 driving axles. This ensures that the material positioned between the pairs of cutting members 40 is cut by the cutting plates 41. The cutting plates 41, or blades, of associated pairs of cutting members 40 also mesh with each other as their bases 32 are rotated to prevent the cutting plates 41 from striking each other while ensuring that the food is properly cut.

The plurality of pairs of cutting members 40 includes a pair of first cutting members 44 each having a cylindrically shaped one of the bases 32. Each of the first cutting members 44 has a single cutting plate 41 extending between corresponding ones of the first 33 and second 34 ends. The bases 32 of the first cutting members 44 have a circumference equal to at least 4 inches. The single cutting plate 41 of the first cutting members 44 extend away from their respective bases a distance greater than 0.5 inches to allow for large cuts to be made to wide food items such as a large piece of meat or thick vegetables.

The plurality of pairs of cutting members 40 includes a pair of second cutting members 46 each including a frusta-conically shaped one of the bases 32. Each of the second cutting members 46 has a plurality of cutting plates 41 attached thereto and extending between corresponding ones of the first 33 and second 34 ends. The cutting plates 41 of the second cutting members 46 are spaced from each other a distance of less than 0.5 inches and extend away from associated ones of the bases 32 less than 0.25 inches. The second cutting members 46 may be used for grating cheese as well as finely cutting vegetables.

Figure 5:
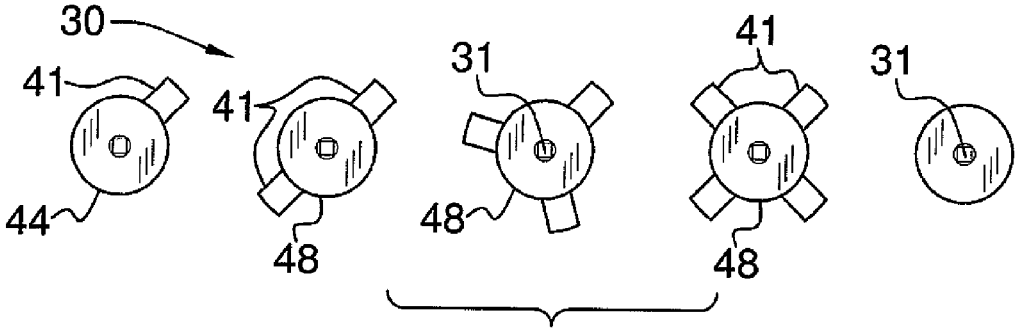
FIG. 5 is an end view of plurality of food manipulating members of the present invention.
Figure 6:
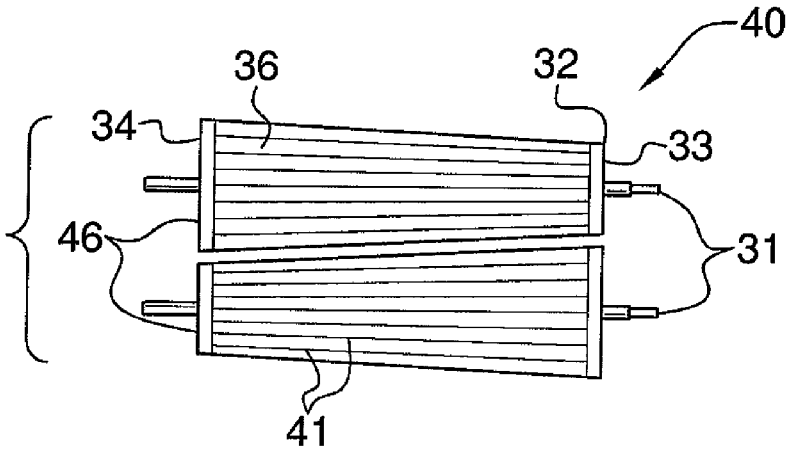
FIG. 6 is a top view of a pair of cutting members of the present invention.
Figure 7:
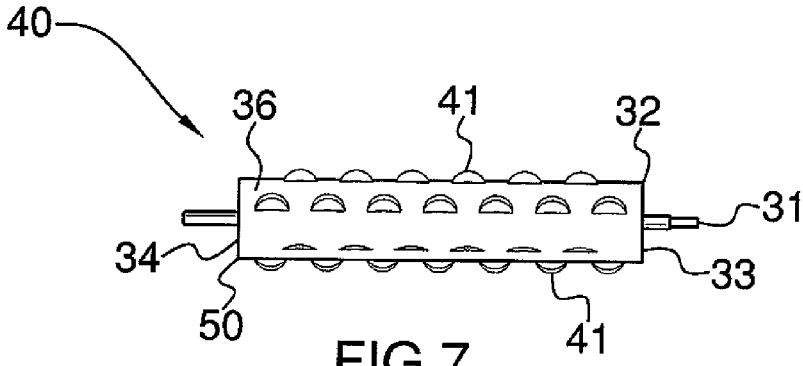
FIG. 7 is a top view of a cutting member of the present invention.
Figure 8:
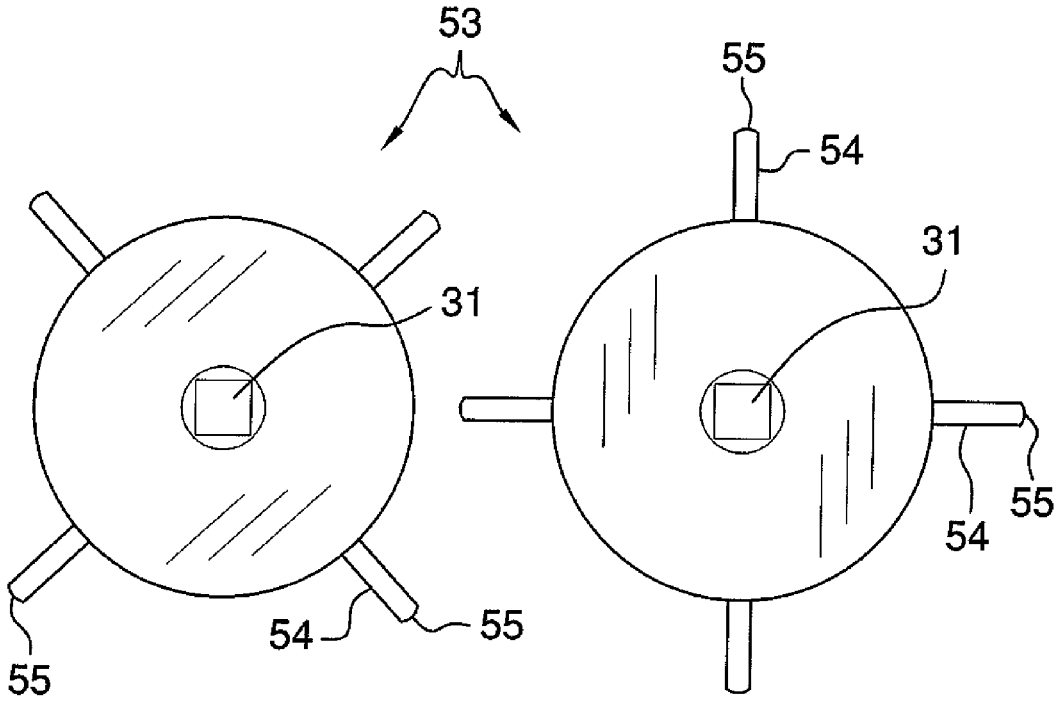
FIG. 8 is an end view of tenderizers of the present invention.

The plurality of pairs of cutting members 40 includes a pair of third cutting members 48 each including a cylindrically shaped one of the bases 32. Each of the third cutting members 48 has at least two cutting plates 41 extending between corresponding ones of the first 33 and second 34 ends and each extends away from associated ones of the bases 32 a distance greater than 0.5 inches. As shown in FIG. 5, the third cutting members 48 may include any number of cutting plates 41 and may be selected depending on the desired length between cuts.

The plurality of pairs of cutting members 40 includes a pair of fourth cutting members 50 each including a cylindrically shaped one of the bases 32. Each of the fourth cutting members 50 has a plurality of cutting plates 41 attached thereto. The cutting plates 41 of the fourth cutting members 50 are positioned in one of a plurality of rows of cutting plates 41. The rows are orientated parallel to each other and extend between the first 33 and second 34 ends of associated ones of the bases. The rows each include at least three cutting plates 41 is spaced with respect to each other. The cutting plates 41 of the fourth cutting members 50 are aligned with spaces between cutting plates 41 of adjacent rows. The rows are space from each other a distance less than 1 inch. The fourth cutting members 50 are used for finer cutting of vegetables.

The plurality of pairs of food engaging members 30 also includes a pair of rollers 52. The rollers 52 have a cylindrically shaped one of the bases 32 and are devoid of any cutting plates 41. A receiving space is defined between the rollers 52 when the rollers 52 are coupled to the first and second driving axles. The receiving space is between 0.5 inch and 0.05 inch and shelled food is positionable between the rollers 52 to shell the shelled food. The rollers 52 may also be used for making pasta.

The plurality of pairs of food engaging members 30 also includes a pair of tenderizers 53. The tenderizers 52 have a cylindrically shaped or frusto-conical one of the bases 32 and are devoid of any cutting plates 41. A receiving space is defined between the tenderizers 53 when the tenderizers 53 are coupled to the first 25 and second 26 driving axles. The receiving space is greater than 0.50 inches and meats are positionable between the tenderizers 53 to tenderize the meat. A plurality of blunted plates 54 is attached to the tenderizers 53 to tenderize the meat. The blunted plates 54 have blunted free ends 55 that will not cut the meat and extend away from the tenderizers a distance less than ½ the distance between said tenderizers when said tenderizers are coupled to the first 25 and second 26 driving axles.

A pair of guards 60 is provided. Each of the guards 60 includes a base wall 61 and a vertical wall 62 integrally coupled to and extending upwardly from the base wall 61. A plurality of fasteners 63 is attached to the table 12 and releasably attaches the guards 60 to the table 12 so that the guards 60 extend upwardly from the table 12. The vertical walls 62 are each orientated perpendicular to the table 12. The vertical walls 62 each have a bottom edge 64 and a top edge 65. A distance between the top edges 65 is equal to a distance between the bottom edges 64.

In use, food is positionable between the food manipulating members 30 and the motor 22 turned on so that the food manipulating members 30 engage the food as the food moves downwardly through the aperture 17. Depending on the type of food being processed as well as the type of cut required, the food manipulating members 30 may be interchanged as needed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A food cutting apparatus comprising:

a table having an upper side and a lower side, a plurality of legs being attached to and extending downwardly from said lower side, said upper side having an aperture extending therein and through said lower side;

a gear housing being mounted on said table and being positioned adjacent to said aperture;

a gear assembly being mounted within said gear housing, said gear assembly including a first drive gear and a second drive gear, wherein said first and second drive gears rotate in opposite directions with respect to each other when said gear assembly is actuated;

a motor being mechanically coupled to said gear assembly and being adapted for actuating said gear assembly;

a first driving axle being attached to said first drive gear, said first driving axle extending through said housing and toward said aperture, said first driving axle having a free end defining a first coupler;

a second driving axle being attached to said second drive gear, said second driving axle extending through said housing and toward said aperture, said second driving axle having a free end defining a second coupler, said first and second driving axles being orientated parallel with respect to each other;

a plurality of pairs of food manipulating members, each of said manipulating members including;

a shaft, each of said first and second driving axles receiving and releasably engaging said shaft of an associated one of said food manipulating members;

a base having a first end, a second end and a perimeter wall extending between said first and second ends, said first end being attached to said shaft, said shaft being centered on said first end and being aligned with a longitudinal axis of said base extending through said first and second ends;

said plurality of pairs of food manipulating members including a plurality of pairs of cutting members, each of said cutting members including at least one cutting plate being attached to said base, said at least one cutting plate extending over said aperture when said shaft is attached to said one of said first and second driving axles, said at least one cutting plate of a one cutting member being spaced less than 0.05 inches from said base of another one of said cutting members when associated ones of a pair of cutting members are coupled to said first and second driving axles;

a pair of guards, each of said guards includes a base wall and a vertical wall integrally coupled to and extending upwardly from said base wall; and wherein food is positionable between said food manipulating members and said motor turned on such that said food manipulating members engage the food as the food moves downwardly through the aperture.

2. The apparatus according to claim 1, wherein said plurality of pairs of cutting members includes;

a pair of first cutting members each including a cylindrically shaped one of said bases, each of said first cutting members having a single cutting plate extending between corresponding ones of said first and second ends, said bases of said first cutting members having a circumference equal to at least 4 inches; and a pair of second cutting members each including a frusto-conically shaped one of said bases, each of said second cutting members having a plurality of cutting plates attached thereto and extending between corresponding ones of said first and second ends, said cutting plates of said second cutting members being spaced from each other a distance of less than 0.5 inches and extending away from associated ones of said bases less than 0.25 inches.

3. The apparatus according to claim 2, wherein said plurality of pairs of cutting members includes a pair of third cutting members each including a cylindrically shaped one of said bases, each of said third cutting members having at least two cutting plates extending between corresponding ones of said first and second ends and extending away from associated ones of said bases a distance greater than 0.5 inches.

4. The apparatus according to claim 3, wherein said plurality of pairs of cutting members includes a pair of fourth cutting members each including a cylindrically shaped one of said bases, each of said fourth cutting members having a plurality of cutting plates attached thereto, said cutting plates of said fourth cutting members being positioned in one of a plurality of rows of cutting plates, each of said rows being orientated parallel to each other and extending between said first and second ends of associated ones of said bases, said rows each including at least three cutting plates being spaced with respect to each other, said cutting plates of said fourth cutting members being aligned with spaces between cutting plates of adjacent rows.

5. The apparatus according to claim 3, wherein said plurality of pairs of food engaging members includes a pair of rollers, said rollers each having a cylindrically shaped one of said bases, a receiving space being defined between said rollers when said rollers are coupled to said first and second driving axles, said receiving space being between 0.5 inch and 0.05 inch, wherein shelled food is positionable between said rollers to shell the shelled food.

6. The apparatus according to claim 1, wherein said plurality of pairs of food engaging members includes a pair of rollers, said rollers each having a cylindrically shaped one of said bases, a receiving space being defined between said rollers when said rollers are coupled to said first and second driving axles, said receiving space being between 0.5 inch and 0.05 inch, wherein shelled food is positionable between said rollers to shell the shelled food.

7. The apparatus according to claim 1, further including a plurality of fasteners being attached to said table and releasably attaching said guards to said table such that said guards extend upwardly from said table, said vertical walls each being orientated perpendicular to said table, each of said vertical walls having a bottom edge and a top edge, a distance between said top edges being equal to a distance between said bottom edges.

8. The apparatus according to claim 1, wherein said plurality of pairs of food engaging members includes a pair of tenderizers, each of said tenderizers including a cylindrically shaped or a frusto-conical shaped one of said bases, each of said tenderizers being devoid of any cutting plates, a receiving space being defined between said tenderizers when said tenderizers are coupled to said first and second driving axles, said receiving space being greater than 0.50 inches and meat is positionable between said tenderizers to tenderize the meat, a plurality of blunted plates being attached to said tenderizers to tenderize the meat, said blunted plates being unable to cut the meat and extending away from the tenderizers a distance less than ½ the distance between said tenderizers when said tenderizers are coupled to said first and second driving axles.

9. A food cutting apparatus comprising:

a table having an upper side and a lower side, a plurality of legs being attached to and extending downwardly from said lower side, said upper side having an aperture extending therein and through said lower side;

a gear housing being mounted on said table and being positioned adjacent to said aperture;

a gear assembly being mounted within said gear housing, said gear assembly including a first drive gear and a second drive gear, wherein said first and second drive gears rotate in opposite directions with respect to each other when said gear assembly is actuated;

a motor being mechanically coupled to said gear assembly and being adapted for actuating said gear assembly;

a first driving axle being attached to said first drive gear, said first driving axle extending through said housing and toward said aperture, said first driving axle having a free end defining a first coupler;

a second driving axle being attached to said second drive gear, said second driving axle extending through said housing and toward said aperture, said second driving axle having a free end defining a second coupler, said first and second driving axles being orientated parallel with respect to each other;

a plurality of pairs of food manipulating members, each of said manipulating members including;

a shaft, each of said first and second driving axles receiving and releasably engaging said shaft of an associated one of said food manipulating members;

a base having a first end, a second end and a perimeter wall extending between said first and second ends, said first end being attached to said shaft, said shaft being centered on said first end and being aligned with a longitudinal axis of said base extending through said first and second ends;

said plurality of pairs of food manipulating members including a plurality of pairs of cutting members, each of said cutting members including at least one cutting plate being attached to said base, said at least one cutting plate extending over said aperture when said shaft is attached to said one of said first and second driving axles, said at least one cutting plate of a one cutting member being spaced less than 0.05 inches from said base of another one of said cutting members when associated ones of a pair of cutting members are coupled to said first and second driving axles;

said plurality of pairs of cutting members including a pair of first cutting members each including a cylindrically shaped one of said bases, each of said first cutting members having a single cutting plate extending between corresponding ones of said first and second ends, said bases of said first cutting members having a circumference equal to at least 4 inches;

said plurality of pairs of cutting members including a pair of second cutting members each including a frusto-conically shaped one of said bases, each of said second cutting members having a plurality of cutting plates attached thereto and extending between corresponding ones of said first and second ends, said cutting plates of said second cutting members being spaced from each other a distance of less than 0.5 inches and extending away from associated ones of said bases less than 0.25 inches;

said plurality of pairs of cutting members including a pair of third cutting members each including a cylindrically shaped one of said bases, each of said third cutting members having at least two cutting plates extending between corresponding ones of said first and second ends and extending away from associated ones of said bases a distance greater than 0.5 inches;

said plurality of pairs of cutting members including a pair of fourth cutting members each including a cylindrically shaped one of said bases, each of said fourth cutting members having a plurality of cutting plates attached thereto, said cutting plates of said fourth cutting members being positioned in one of a plurality of rows of cutting plates, each of said rows being orientated parallel to each other and extending between said first and second ends of associated ones of said bases, said rows each including at least three cutting plates being spaced with respect to each other, said cutting plates of said fourth cutting members being aligned with spaces between cutting plates of adjacent rows;

said plurality of pairs of food engaging members including a pair of rollers, said rollers each having a cylindrically shaped one of said bases, a receiving space being defined between said rollers when said rollers are coupled to said first and second driving axles, said receiving space being between 0.5 inch and 0.05 inch, wherein shelled food is positionable between said rollers to shell the shelled food;

a pair of guards, each of said guards includes a base wall and a vertical wall integrally coupled to and extending upwardly from said base wall;

a plurality of fasteners being attached to said table and releasably attaching said guards to said table such that said guards extend upwardly from said table, said vertical walls each being orientated perpendicular to said table, each of said vertical walls having a bottom edge and a top edge, a distance between said top edges being equal to a distance between said bottom edges;

said plurality of pairs of food engaging members includes a pair of tenderizers, each of said tenderizers including a cylindrically shaped or a frusto-conical shaped one of said bases, each of said tenderizers being devoid of any cutting plates, a receiving space being defined between said tenderizers when said tenderizers are coupled to said first and second driving axles, said receiving space being greater than 0.50 inches and meat is positionable between said tenderizers to tenderize the meat, a plurality of blunted plates being attached to said tenderizers to tenderize the meat, said blunted plates being unable to cut the meat and extending away from the tenderizers a distance less than ½ the distance between said tenderizers when said tenderizers are coupled to said first and second driving axles; and wherein food is positionable between said food manipulating members and said motor turned on such that said food manipulating members engage the food as the food moves downwardly through the aperture.

* * * * *